United States Patent [19]

VanIseghem, Jr.

[11] 3,939,976

[45] Feb. 24, 1976

[54] PREFABRICATED TABLE SETTING

[76] Inventor: Edmond J. VanIseghem, Jr., 96 W. Sherwood Drive, Overland, Mo. 63114

[22] Filed: Sept. 5, 1974

[21] Appl. No.: 503,304

[52] U.S. Cl. ..... 206/390; 108/50; 108/90; 150/52 R; 206/820

[51] Int. Cl.[2] B65D 1/34; B65D 85/67; A45B 13/08

[58] Field of Search ..... 206/390, 373, 549, 72, 206/818, 820; 220/23.8, 8, 65; 150/52 R; 229/1.5 C; 108/90, 50

[56] References Cited

UNITED STATES PATENTS

| | | | |
|---|---|---|---|
| 1,407,792 | 2/1922 | Hatzung | 206/373 |
| 1,881,416 | 10/1932 | Whalt | 220/23.8 |
| 2,651,926 | 9/1953 | Enslein | 220/23.8 |
| 2,880,902 | 4/1959 | Owsen | 220/8 |
| 3,050,185 | 8/1962 | Crain | 206/390 |
| 3,376,974 | 4/1968 | Hilliard | 206/72 |

*Primary Examiner*—William T. Dixson, Jr.
*Attorney, Agent, or Firm*—Cohn, Powell & Hind

[57] ABSTRACT

A roll of flexible material is divided into multiple table place setting sections. Each place setting section includes a relatively recessed circular portion formed in the flexible material and also eating utensils which are attached to the flexible material. The sections are separated from each other by perforations for removal of one or more as desired.

4 Claims, 6 Drawing Figures

PREFABRICATED TABLE SETTING

BACKGROUND OF THE INVENTION

This invention relates to prefabricated place settings and particularly to a roll of disposable place setting sections.

It has long been recognized that conventional china dishes and metal eating utensils are impractical for many occasions such as picnics and barbecues or for use in large informal gatherings at which meals are to be served. In consequence, disposable dishes and utensils are commonly used at such events. However, such items still require to be arranged into table place settings and to this extent provide no advantage over conventional items.

The provision of an instant place setting which is provided by this invention overcomes this and other disadvantages in a manner not revealed in the known prior art.

SUMMARY OF THE INVENTION

It is an important object of this invention to provide instant place settings in the form of a roll of flexible material divided into sections, each section having a recessed plate portion impressed thereon.

Another important object is to provide each place setting section with a set of eating utensils attached to the flexible material arranged ready for use after unrolling.

Yet another object is to provide a seating portion of each section for a collapsible cup and to provide means holding said cup in place on said seating portion.

An important object is to provide a double row of place setting sections having a combined width equal to the width of a table and separated by a longitudinal perforation line, and to provide transverse perforation lines between each section so that separation of individual place setting sections from the roll may be easily achieved.

It is an important object to provide a supply of disposable table setting sections in rolled form which are relatively simple and inexpensive to manufacture and can be used with great facility.

DESCRIPTION OF THE PREFERRED EMBODIMENT

Figures 1, 2, 3, 4, 5, 6:
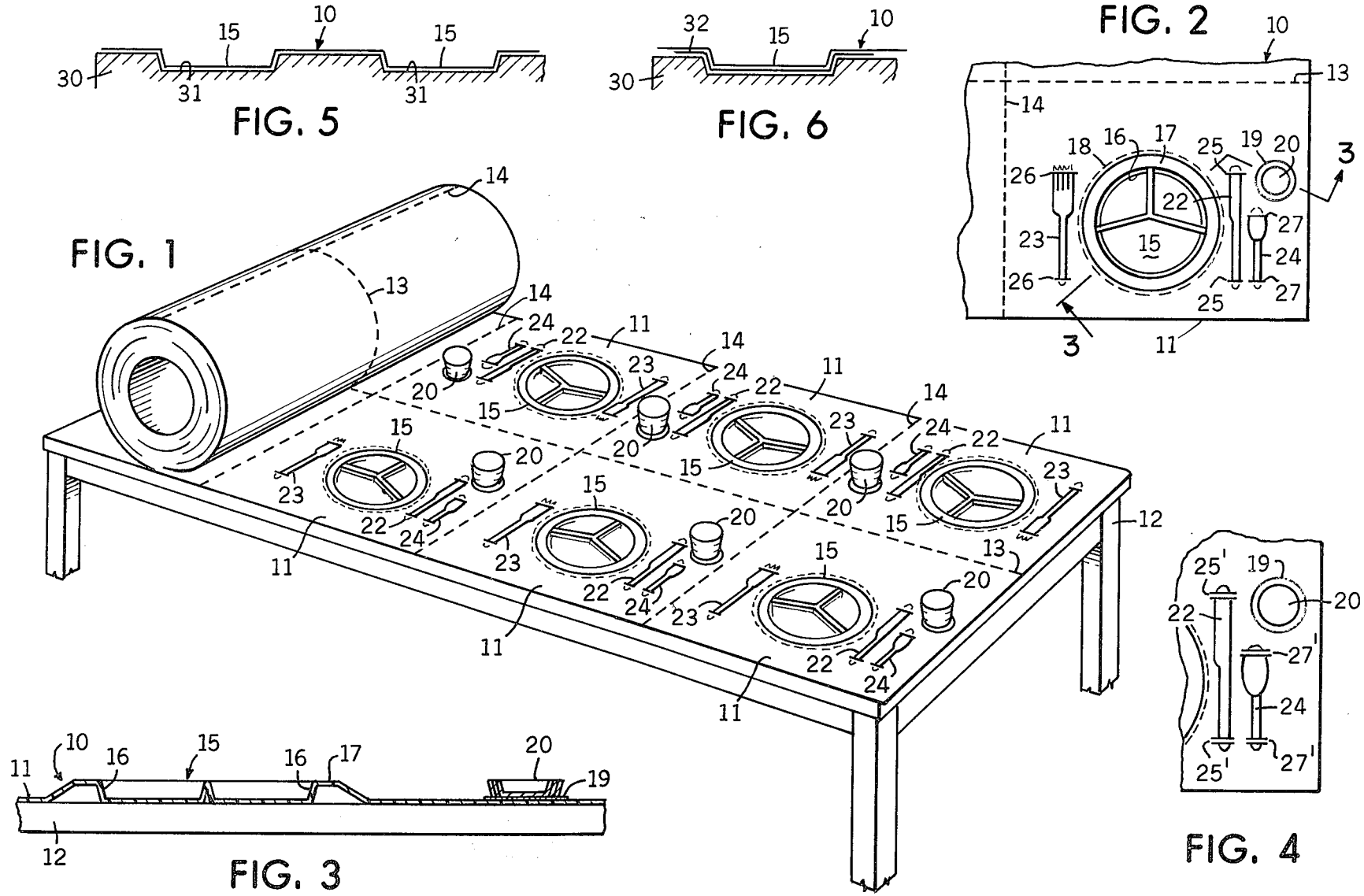
FIG. 1 is a perspective view of a table width roll of place settings.
FIG. 2 is an enlarged plan view illustrating a single place setting section.
FIG. 3 is a fragmentary sectional view taken on line 3—3 of FIG. 2.
FIG. 4 is an enlarged fragmentary view of a section illustrating an alternative attachment means for the eating utensils.
FIG. 5 is an illustration of a means of forming the impressed plate portions.
FIG. 6 is a similar illustration for a reinforced plate portion.

Referring now by characters of reference to the drawing and first to FIG. 1 it will be understood that the prefabricated multiple place setting combination is provided essentially by an elongate web 10 in the form of a roll of flexible material such as paper or plastic which is subdivided both longitudinally and transversely into a plurality of place setting sections 11. As shown, the sections 11 are disposed in longitudinally aligned pairs having a combined width equal to that of a conventional picnic table such as indicated by numeral 12. Preferably, the longitudinal and transverse divisions 13 and 14 defining each section are perforated so that the sections 11 can, if desired, be separated from the rolled web 10. As clearly shown in FIG. 2 read in conjunction with FIG. 3 each section 11 provides a relatively recessed plate portion 15 including an inclined sidewall 16 which is defined by a raised circular rim 17. The plate portion 15 is formed from the web material and is essentially self-supporting. In the preferred embodiment the plate portion is partitioned into stiffening subdivisions. Further, the plate portion 15 is provided with a peripheral perforation 18 so that it can be removed from the web 10 if desired. Each section also includes a cup seating portion 19 in the form of a circular patch in the preferred embodiment, which is suitable for seating a collapsible cup 20. The cup seating portion 19 is provided with a contact adhesive or similar material which coacts with the underside of the cup 20 to hold said cup in place on the section 11. Such adhesive is not intended to provide permanent attachment but merely to provide sufficient holding power to hold the cup in place when the web material is in the roll form and while it is being unrolled. Each section 11 is also provided with eating utensils such as a knife, fork and spoon 22, 23 and 24 respectively which, in the embodiment shown in FIG. 2, are held in place by slits 25, 26 and 27 respectively extending longitudinally of the web material 10 and disposed in transversely spaced pairs. FIG. 4 discloses an alternative means of attaching the eating utensils in place by providing strips indicated, by way of example, by numerals 25' and 27', which may be attached to the material forming section 11, as by adhesive, or which may be formed by double slits.

FIGS. 5 and 6 illustrate a method by which the relatively depressed plate portions 15 may be formed by providing a corresponding die plate generally indicated by numeral 30. The die plate 30 includes a plurality of depressed portions 31 into which the flexible material 10 may be urged, as for example by vacuum forming or by rolls having corresponding formations thereon (not shown). In those instances in which the flexible material 10 requires reinforcement in order for it to be stiff enough to provide a self-supporting plate portion of sufficient depth, a circular reinforcing backing portion of similar flexible material may be provided as shown in FIG. 6 by numeral 32. This backing portion 32 may be adhesively attached to the flexible material 10, in the case of paper, or heat sealed in the case of plastic.

It will be understood that the plate portions 15, the cup seating portions 20 and the attachment means for the eating utensils 22–24 are provided on the web material prior to the temporary attachment of the collapsed cup 21 and the eating utensils so that said cup and utensils can then be attached to the sections 11 and the material then rolled up. In effect, the rolled up sections provide a succession of table settings ready for immediate use, the nature of the roll inherently assisting in preventing the cup 20 from becoming separated therefrom as well as assisting in the retention of the utensils 22–24 prior to the unrolling of the roll. If, for example, a place setting for eight diners is required, as shown in FIG. 1, the roll is simply placed at one end of the table 12 and unrolled toward the other end until eight place setting sections 11 are revealed. At this time the eight sections may be separated from the web as a whole by simply tearing along the transverse perforated strip 14 closest to the end of the table. The collapsed cups 21 can then be opened out into their operative drinking condition and the eating utensils 22–24 removed from their attachment means by the individual diner. It will be understood that the flexible nature of the web 10 results in the web material taking up a relatively flat formation conforming to the surface of the table 10 between the plate portions 15, as is cleary indicated in FIG. 3.

I claim as my invention:

1. Multiple prefabricated table place settings, comprising:

a. an elongate web of flexible material including a plurality of longitudinally disposed and integral place setting sections stored in a web roll prior to use, each section including a first relatively raised rim portion formed integrally with and as a continuation of the web, the rim portion defining a relatively depressed plate portion formed integrally with and as a continuation of the web, the web extending from the rim portions of the sections conforming flexibly to the support between the plate portions, b. a plurality of eating utensils disposed on each section, and c. means holding said utensils in place on each section.

2. Multiple place settings as defined in claim 1, in which:

d. each section includes a cup seating portion formed integrally with the web, and e. a collapsed telescopic cup seated in the cup seating portion and retained by the web when in the web roll.

3. Multiple place settings as defined in claim 1, in which:

d. each section includes a reinforcing back-up sheet secured to the web at the rim and plate portions for reinforcement.

4. Multiple prefabricated place settings comprising:

a. an elongate web of flexible material including a plurality of longitudinally disposed, widthwise adjacent pairs of integral place setting sections stored in a web roll prior to use, each section including a relatively raised rim portion formed integrally with and as a continuation of the web, the rim portion defining a relatively depressed circular plate portion formed integrally with and as a continuation of the web, the web extending from the rim portions of the sections conforming to the support between the plate portions, said sections being defined by longitudinal and transverse perforations in the web for selective separation of the sections, b. a plurality of utensils disposed on each section, c. means holding said utensils in place on each section, d. a cup disposed on each section, and e. means holding each of said cups in place on its associated section.

* * * * *